US006222570B1

(12) United States Patent
Takayama et al.

(10) Patent No.: US 6,222,570 B1
(45) Date of Patent: Apr. 24, 2001

(54) THERMAL PRINTING METHOD AND THERMAL PRINTER

(75) Inventors: Michitoshi Takayama; Hiroshi Fukuda; Hisashi Enomoto; Sugio Makishima, all of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/329,794

(22) Filed: Jun. 10, 1999

(30) Foreign Application Priority Data

Jun. 12, 1998 (JP) ..... 10-165081

(51) Int. Cl.[7] ..... B41J 35/16
(52) U.S. Cl. ..... 347/172
(58) Field of Search ..... 347/172, 171, 347/176, 175, 184, 185–186, 195–196, 191; 358/1.18; 345/435

(56) References Cited

U.S. PATENT DOCUMENTS 5,669,720 * 9/1997 Negishi et al. ..... 400/120.05
5,892,534 * 4/1999 Maruyama et al. ..... 345/435
6,034,785 * 3/2000 Itoh ..... 358/1.18
6,037,961 * 3/2000 Saito et al. ..... 347/185

* cited by examiner

*Primary Examiner*—N. Le
*Assistant Examiner*—K. Feggins
(74) *Attorney, Agent, or Firm*—Sughrue, Mion, Zinn, Macpeak & Seas, PLLC

(57) ABSTRACT

A thermal printer has a thermal head, which applies recording heat energy to an effective recording region on a thermosensitive recording sheet. The thermal head includes an array of heating elements arranged in a main scan direction. The recording sheet is conveyed relative to the thermal head in a sub scan direction perpendicular to the main scan direction, for recording at least one input image to the recording sheet. The effective recording region is separated into an insertion region, a template region and a blank frame region. The frame region extends in a linear shape with a small width. A first borderline is defined between the insertion region and the frame region, and a second borderline is defined between the template region and the frame region. The first borderline includes at least one first borderline segment being straight or curved, extends crosswise to the sub scan direction and is inclined with reference to the main scan direction. The input image is recorded in the insertion region. At least one template image is recorded in the template region, to constitute a synthesized image in combination with the input image.

17 Claims, 9 Drawing Sheets

THERMAL PRINTING METHOD AND THERMAL PRINTER

BACKGROUND OF THE INVENTION

1. Field of the Invention

The present invention relates to a thermal printing method and thermal printer. More particularly, the present invention relates to a thermal printing method and thermal printer in which irregularities in a recorded density are prevented from occurrence.

2. Description Related to the Prior Art

A thermal printer includes a thermal head, which applies heat to recording material to print an image. There are two examples of thermal printers, including a direct thermal recording type in which the thermal head heats thermosensitive recording paper to color it directly, and a thermal transfer type in which a back surface of ink ribbon is heated by the thermal head to transfer ink to paper.

To record a color image according to the direct thermal recording, a thermosensitive recording paper called "Thermo-Autochrome paper" is used. The recording paper includes a support and at least three thermosensitive coloring layers. The coloring layers are cyan, magenta and yellow coloring layers. The recording paper and the thermal head are conveyed relative to one another in a sub scan direction. The thermal head presses and heats the recording paper to record a full-color image. To color the coloring layers selectively, the recording paper has heat sensitivity different between the coloring layers. The cyan coloring layer is positioned the most deeply, and has the highest heat sensitivity. The yellow coloring layer is positioned the least deeply, and has the lowest heat sensitivity. Before recording to the next one of the coloring layers, a previously colored one of the coloring layers is fixed by application of ultraviolet rays, and prevented from being colored for higher coloring density.

The thermal head includes an array of numerous heating elements arranged in a main scan direction, for recording one line after another of each of the colors. For this operation, the heating elements apply bias heat energy to the recording paper. The bias heat energy is such an amount that it heats the recording paper to set the recording paper in a state short of developing color and prepares it for further application of heat energy. Then the heating elements apply image heat energy to the recording paper. The image heat energy is an amount for coloring at a desired density. Pixels arranged on the recording paper virtually are colored to record dots. The bias heat energy is constant and depends on each of the coloring layers. The image heat energy changes and depends on input image data representing a gradation data. When the image heat energy is finished, the heating elements are left to stand in a cooling period. After the heating elements are cooled, one other line is recorded.

A coefficient $\mu$ of friction between the thermal head and the recording paper changes and depends upon a surface temperature of the recording paper. If the temperature of the vicinity of the heating elements in the thermal head is low, the coefficient $\mu$ of friction is great. Load to the conveyance is high. If the temperature of the vicinity of the heating elements is high, the coefficient of friction is small. The load to the conveyance is low.

When the temperature of the thermal head is changed to increase or decrease the load to the conveyance, there is an increase or decrease in distortion of the platen roller or platen drum, distortion of a feed roller or conveyor roller set, extension or shrinkage of belts for transmission of rotation to the conveyor roller set, and distortion of a roller shaft. A paper conveyor system for the recording paper is associated with a stepping motor as a power source. A rotor of the motor may be stopped in a position different from an accurate stop position, but where the magnetic force and the load to the conveyance are balanced. Note that such recoverable changes in the state are herein referred to as distortions of the paper conveyor system. At each time that the load to the conveyance changes, the distortions of the paper conveyor system are either increased or decreased. Then a conveying speed of the recording paper changes in a temporary manner.

If the conveying speed is higher than a predetermined, value an interval between recorded lines is increased. Heat energy ($mJ/mm^2$) applied by the heating elements to the recording paper per unit area is small. Coloring density of a line being recorded becomes low, to create a low-density stripe which looks blank or white. As the conveying speed is lower than a predetermined, value the interval between adjacent lines is lowered. The coloring density of the line being recorded rises, to create a high-density stripe which looks dark or black. Those high- and low-density stripes constitute unevenness in the coloring density.

It is conceivable that a synthesized image is printed by combining an input image, a template image preset to be printed about the input image, and a frame to be disposed about the input image and inside the template image. In other words, the frame constitutes a periphery of an insertion region into which the input image is inserted inside the template image. The frame may have portions extending in parallel with the main scan direction. When the heating elements are positioned at portions of the frame, the heating elements have a relatively low temperature. If an image surrounded by the frame has a high density, portions for such an image are positioned at the heating elements so that a greater part of the heating elements abruptly comes to generate high heat energy. The temperature of the thermal head rises abruptly. The surface temperature of the recording paper in contact with the heating elements rises. The friction coefficient decreases. The conveying speed of the recording paper becomes higher temporarily than a predetermined value. There occurs a low-density stripe where the coloring density of a line is considerably low.

If blank portions of the frame are printed immediately after printing a high-density portion, the conveying speed of the recording paper becomes lower temporarily than a predetermined value. A high-density stripe occurs, in which the coloring density of a line being recorded is remarkably high.

SUMMARY OF THE INVENTION

In view of the foregoing problems, an object of the present invention is to provide a thermal printing method and thermal printer in which unevenness in a recorded density is prevented from occurrence.

In order to achieve the above and other objects and advantages of this invention, a thermal printing method is provided, in which recording heat energy is applied by a thermal head to an effective recording region on a recording material, the thermal head includes an array of heating elements arranged in a main scan direction, the thermal head and the recording material are conveyed relative to one another in a sub scan direction substantially perpendicular to the main scan direction, for recording at least one input image to the recording material. In the thermal printing method, the effective recording region is separated into an insertion region, a template region and a blank frame space, the frame space extending in a linear shape with a small width, a first borderline being defined between the insertion region and the frame space, a second borderline being defined between the template region and the frame space, the first borderline including at least one first borderline segment being straight or curved, extending crosswise to the sub scan direction and being inclined with reference to the main scan direction. The input image is recorded in the insertion region. At least one template image is recorded in the template region, so as to constitute a synthesized image in combination with the input image.

In a preferred embodiment, the second borderline includes at least one second borderline segment being straight or curved, extending crosswise to the sub scan direction and being inclined with reference to the main scan direction.

The heating element array, while positioned at the first or second borderline segment, changes progressively from one of first and second states to the other, and when in the first state, a small number of heating elements included in the heating element array are driven, and when in the second state, a great number of heating elements included in the heating element array are driven.

By this construction, unevenness in a recorded density is prevented from occurrence, because there occurs no such event that the number of driven heating elements in the array would abruptly decrease.

In a preferred embodiment, the insertion region has a substantially quadrilateral shape, and the template region is disposed around the insertion region.

The template image is predetermined.

The input image has a rectangular quadrilateral shape, and has first and second side lines extending in the main scan direction, the first side line is associated with the first borderline segment, but offset therefrom with a difference. Furthermore, the input image data is corrected in consideration of the difference, for adapting a portion of the input image along the first side line to the first borderline segment.

According to another aspect of the invention, the effective recording region is separated into an insertion region and a template region by use of a borderline, the borderline including at least one borderline segment being straight or curved, extending crosswise to the sub scan direction and being inclined with reference to the main scan direction. The input image is recorded in the insertion region. At least one template image is recorded in the template region, so as to constitute a synthesized image in combination with the input image.

According to still another aspect of the invention, the effective recording region is separated into an insertion region and a template region by use of a frame image, the frame image extending in a linear shape with a small width, including at least one frame image segment extending in the main scan direction, and having a predetermined density. The input image is recorded in the insertion region. At least one template image is recorded in the template region. The frame image is recorded in the effective recording region between the insertion region and the template region, so as to constitute a synthesized image in combination with the input image and the template image.

The insertion region has a substantially quadrilateral shape, and the template region is disposed around the insertion region.

The template image and the frame image are predetermined.

An entirety of a frame image has the predetermined density.

The frame image is gray.

The recording heat energy is a combination of bias heat energy and image heat energy, the bias heat energy is so predetermined as to set the recording material in a heated state directly short of starting coloring the recording material, and the image heat energy is determined according to the density to be recorded to the recording material. The predetermined density is recordable by applying at least 120% as high heat energy to the recording material as the bias heat energy.

According to a further aspect of the invention, a thermal printer has a first memory for storing the input image data. A second memory stores template data and information of first and second borderlines, the template data representing at least one template image, the first and second borderlines being disposed inside the effective recording region, the effective recording region being separated into an insertion region, a template region and a blank frame space, the frame space extending in a linear shape with a small width, the first borderline being defined between the insertion region and the frame space, the second borderline being defined between the template region and the frame space, the first borderline including at least one first borderline segment being straight or curved, extending crosswise to the sub scan direction and being inclined with reference to the main scan direction. An image synthesis circuit produces synthesized image data in accordance with the input image data, the template data and the information of the first and second borderlines, the synthesized image data representing a synthesized image in which the input image is disposed in the insertion region and the template image is disposed in the template region. A third memory stores the synthesized image data, the thermal head recording the synthesized image according thereto.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
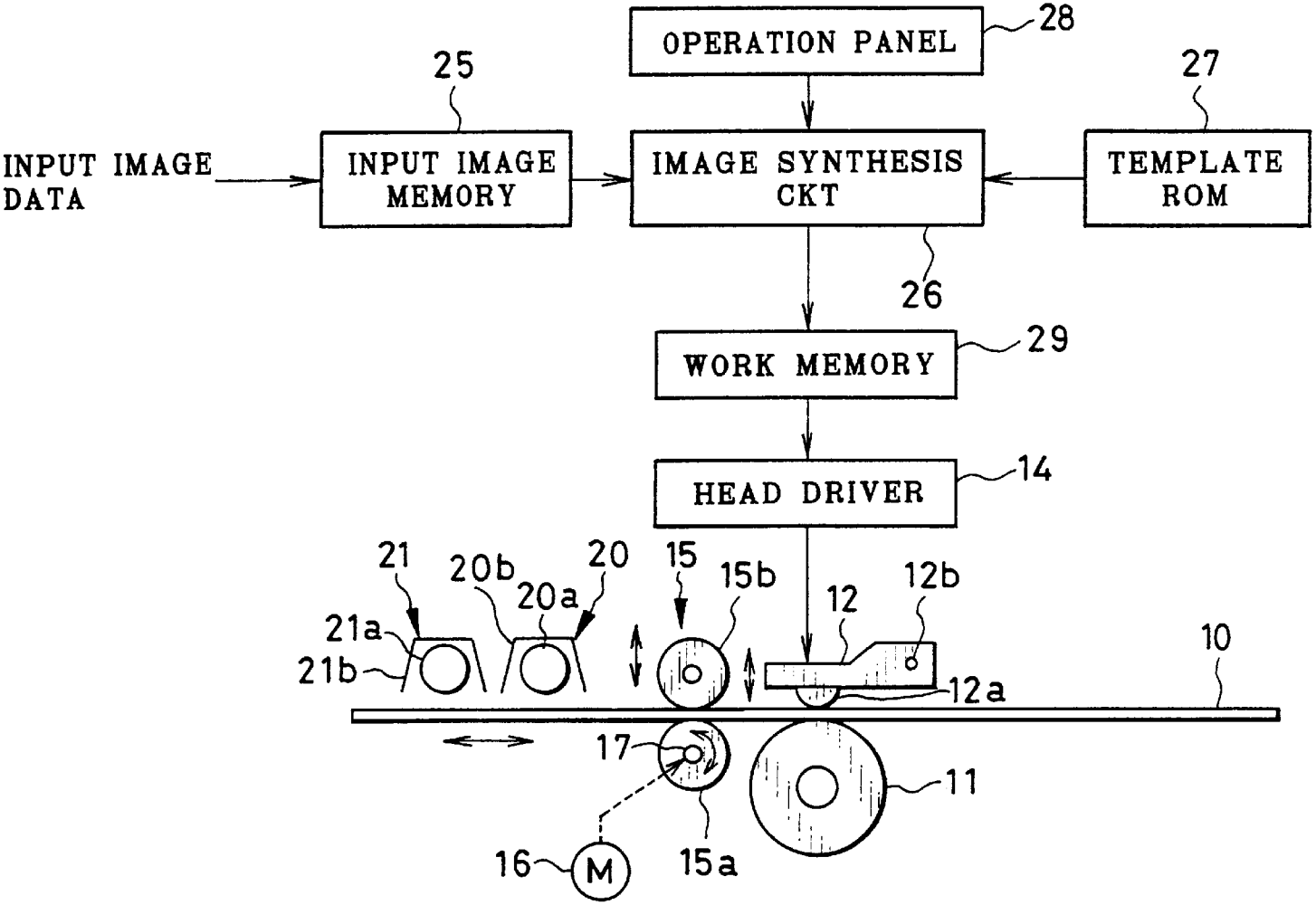
FIG. 1 is an explanatory view illustrating a thermal printer of the present invention.

In FIG. 1, a color thermal printer is illustrated. A color thermosensitive recording sheet 10 is fed from a sheet supply cassette (not shown), and conveyed to a platen roller 11. A thermal head 12 is positioned opposite to the platen roller 11. A bottom of the thermal head 12 has an array 12*a* of heating elements 13 arranged in a main scan direction or width direction of the recording sheet 10. See FIG. 2. The thermal head 12 is movable pivotally at a shaft 12*b* and between a press position and a retracted position. The thermal head 12, when in the press position, is pressed against the recording sheet 10 on the platen roller 11 for image recording, and when in the retracted position, is away from the recording sheet 10.

The recording sheet 10 includes a support, thermosensitive coloring layers, and a transparent protective layer. The coloring layers are colorable in cyan, magenta and yellow. The magenta coloring layer is optically fixable in response to ultraviolet rays peaking at a wavelength of 356 nm. The yellow coloring layer is optically fixable in response to near ultraviolet rays or peaking at a wavelength of 420 nm. Recording to the coloring layers are in a sequence according to a sequence of the overlaid manner of the coloring layers. If a thermal printer should be used with the recording sheet 10 in which the yellow and magenta coloring layers would be positioned in reverse to those in the present invention, then the recording is effected in the sequence of magenta, yellow and cyan.

In relation to the coloring layers, the magnitude in recording heat energy to be applied thereto is according to the depth in the layer position. In the recording sheet 10, the yellow coloring layer requires the lowest energy of recording heat for developing its color. The cyan coloring layer requires the highest energy of recording heat for developing its color. The recording heat energy is a combination of bias heat energy and image heat energy. The bias heat energy is such an amount that it heats the recording sheet 10 to set the recording sheet 10 in a heated state short of developing color and prepares it for further application of heat energy. The image heat energy is applied after application of the bias heat energy. The bias heat energy is a predetermined constant for each of the coloring layers. The image heat energy is determined for each pixel and according to the intended density to be recorded.

A thermal head driver 14 drives the thermal head 12, which applies heat of bias heat energy and image heat energy to the recording sheet 10 being conveyed forwards, namely to the left in the drawing. An image of each of the three colors is recorded line after line, so that a full-color image is recorded in three-color frame-sequential recording in which the recording sheet 10 is conveyed back and forth for three times.

A feed roller or conveyor roller set 15 is disposed downstream from the platen roller 11, and includes a capstan roller 15*a* and a pinch roller 15*b*. The capstan roller 15*a* is driven by a stepping motor 16. The pinch roller 15*b* is a driven roller rotated during conveyance of the recording sheet 10. The pinch roller 15*b* is movable between a nip position and a released position, and when in the nip position, nips the recording sheet 10 between it and the capstan roller 15*a*, and when in the released position, is away from the recording sheet 10. When the capstan roller 15*a* is rotated by the stepping motor 16, the feed roller set 15 rotates in forward and backward directions, to convey the recording sheet 10 back and forth. For the image recording, the stepping motor 16 is supplied with drive pulses at a constant frequency, and is rotated continuously.

A roller shaft 17 of metal is included in the capstan roller 15*a*, and directly connected with an output shaft of the stepping motor 16. Of course, it is possible to transmit rotation of the stepping motor 16 to the roller shaft 17 by use of pulleys and belts, or a train of gears. There are a yellow fixer 20 and a magenta fixer 21 arranged downstream from the feed roller set 15. The yellow fixer 20 is constituted by an ultraviolet lamp 20*a* and a reflector 20*b*, and emits ultraviolet rays, of which a peak is at the wavelength of 420 nm to fix the yellow color. The magenta fixer 21 is constituted by an ultraviolet lamp 21*a* and a reflector 21*b*, and emits ultraviolet rays, of which a peak is at the wavelength of 365 nm to fix the magenta color.

For an image to be recorded, a video camera, a scanner or the like is used for photographing an object in a photographic field or for reading an image on an original sheet material. Or an image may be initially stored in recording media such as magnetic recording media, and a memory card, from which the image is read for operation of the printer. An input image memory 25 stores the yellow, magenta and cyan image data. In the color thermal printer, an input image is inserted in an insertion region inside a template image, to record a synthesized image. The input image memory 25 as a first memory is used, to which input image data of the input image is written. An image synthesis circuit 26 reads the input image from the input image memory 25. The input image data of each of the colors is, for example, 8-bit data, and represents a gradation value with highness according to density of a pixel to be recorded. The density is high according to the highness of the value of the input image data.

A template ROM 27 as a second memory is connected with the image synthesis circuit 26. The template ROM 27 stores template data which represent plural template images. For recording the synthesized image, an operation panel 28 is operated for selection of template images as desired, and revisions of an input image to be inserted, such as trimming, enlargement, reduction, and rotational changes of orientation of the input image. Note that, instead of the template ROM 27, a magnetic recording medium or memory card may be used for storing the template image, and inserted into the body of the thermal printer.

The image synthesis circuit 26 reads the template data of the template image from the template ROM 27 according to the selected one of the template image at the operation panel 28. The template data is written to a work memory 29 as a third memory. The work memory 29 is a work area which is used for producing synthesized images, and to which the synthesized image data of a synthesized image is written. The image synthesis circuit 26 produces the synthesized image by writing the input image data from the input image memory 25 at an address in the template data in the work memory 29 for the predetermined insertion region.

For the image recording, synthesized image data of each of the colors is read from the work memory 29 sequentially line by line, and sent to the thermal head driver 14. In the process of the bias heating, the thermal head driver 14 drives the heating elements 13 in the heating element array 12*a* at the same time. In the process of the image heating, the thermal head driver 14 selectively drives the heating elements 13 according to the synthesized image data.

Figure 2:
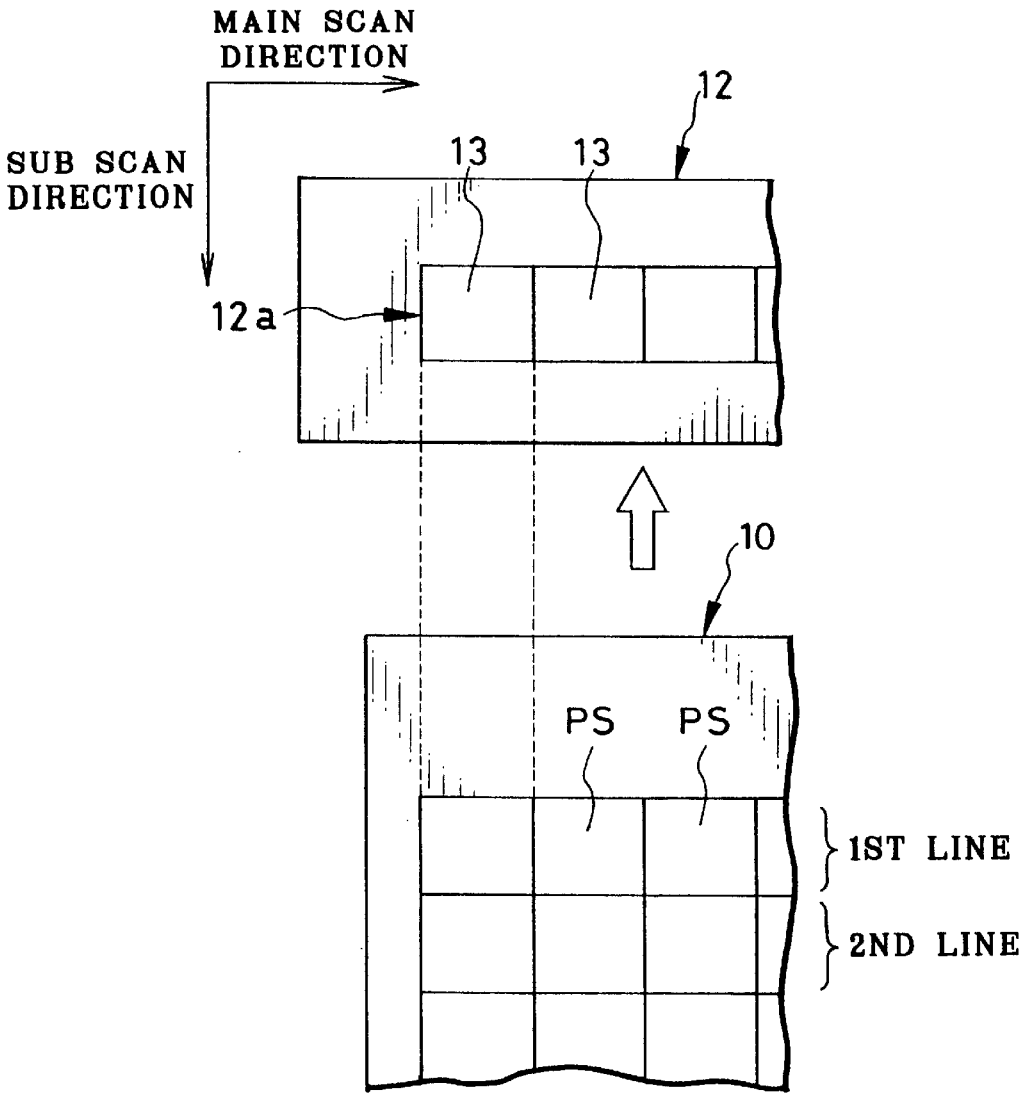
FIG. 2 is an explanatory view in plan, illustrating a relationship between a thermal head and a recording sheet with pixels.

In FIG. 2, a recording state of the recording sheet 10 is illustrated. The array 12*a* of the heating elements 13 in the thermal head 12 records one line after another for each of the colors. Each line extends in the main scan direction, and includes a plurality of pixels PS. The pixels PS are recorded by the heating elements 13. The thermal head 12 records each one line by operation of bias heating, image heating, cooling of the heating elements 13 while the feed roller set 15 conveys the recording sheet 10 by a range of each one line in the sub scan direction. Upon the finish of the conveyance by the one-line range, the next line starts being recorded.

Figure 3:
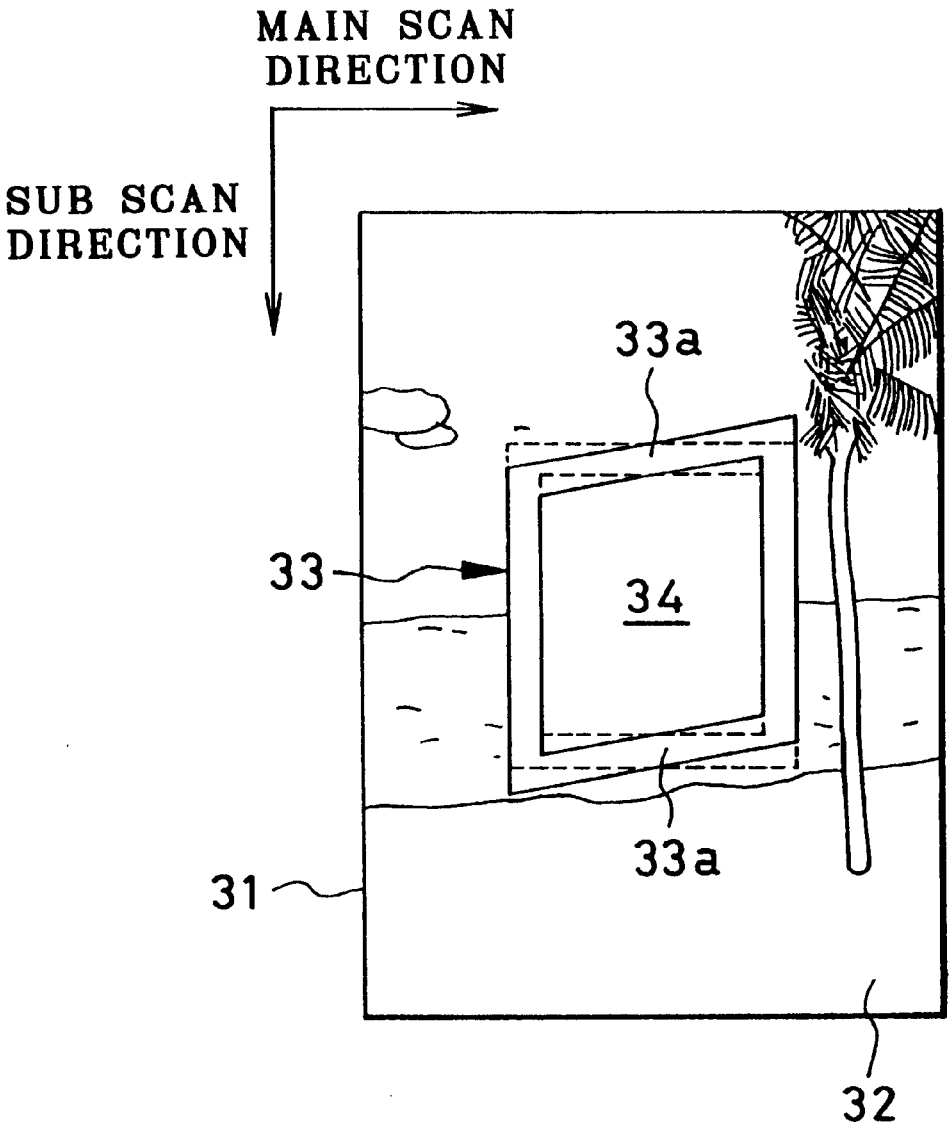
FIG. 3 is an explanatory view in plan, illustrating a template image, a frame region and an insertion region.

In FIG. 3, one example among the template images stored in the template ROM 27 is illustrated. In FIG. 3, a template image 31 is constituted by a background image 32. A frame region or frame space 33 is located about an insertion region 34, into which an input image as principal image is inserted and recorded as a part of a synthesized image. It is to be noted that plural input images may be inserted into the template image 31. The background image 32, although preset in the thermal printer, may be an externally entered background image, and also may be selectable from a plurality of preset background images.

The insertion region 34, surrounded by the frame region 33, has a rectangular quadrilateral shape. The frame region 33 has a predetermined small width, and has a white color without coloring of any of the yellow, magenta and yellow. It is possible for the frame region 33 to be colored lightly. In other words, the frame region 33 may have a frame image where the small-width portion has a certain color at a small density. Frame region segments 33*a* of the frame region 33 are extended almost in the main scan direction, but with an inclination, and are non-parallel to the main scan direction. In the drawing, the broken lines indicate the parallelism to the main scan direction, with reference to which the frame region segments 33*a* are inclined. The inclination is for the purpose of avoiding irregularities in a recorded density due to changes in the load in the conveyance. It is to be noted that the inclination in FIG. 3 is depicted with exaggeration, and is considerably smaller than illustrated, in such a manner that users or viewers of the recording sheet 10 as a hard copy apparently recognizes the exactly horizontal orientation for the frame region segments 33*a* as if the frame region segments 33*a* were not inclined. Note that it is possible to provide the frame region segments 33*a* with a relatively great inclination for the purpose of appearance.

Thus unevenness in the density in the printing is suppressed by use of the template image 31 with the frame region 33 non-parallel with the main scan direction. The portions of the frame region 33 extending in the sub scan direction are not correlated with changes in the load in the conveyance, and may be parallel to the sub scan direction or inclined.

The operation of the present embodiment is described now. To print a synthesized image, at first the operation panel 28 is operated by a user to enter a signal for instructing synthesis of an image. A desired one of the preset template images 31 is selected. According to the selected template image, the image synthesis circuit 26 reads three-color template data of the yellow, magenta and cyan from the template ROM 27, and writes them to the work memory 29. Then the user operates the operation panel 28 and causes a main component of the thermal printer to obtain an input image or principal image. The input image is subjected to photometry in the manner of three-color separation by means of a scanner or the like, so that three-color image data of the yellow, magenta and cyan are written to the input image memory 25.

Figure 4:
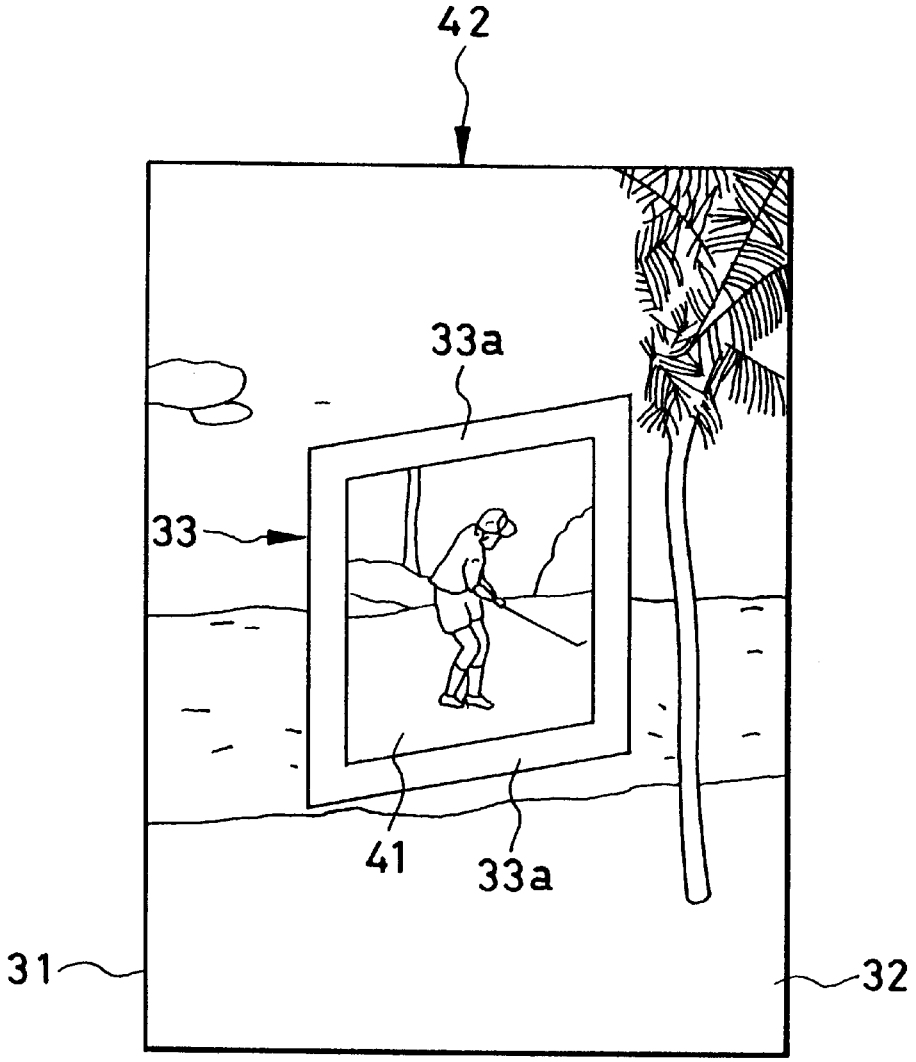
FIG. 4 is an explanatory view in plan, illustrating a synthesized image which includes an input image and the template image.

Upon entry of a command signal for starting printing by operating the operation panel 28, the image synthesis circuit 26 reads three-color image data of the principal image from the input image memory 25, and writes the same to the work memory 29 at an address associated with the background image 32. In FIG. 4, synthesized image data is written to the work memory 29, and represents a synthesized image 42, which is a combination of the template image 31 and an input image 41 or principal image. In the synthesized image 42, the periphery of the input image 41 is surrounded by the frame region 33. Borderlines between the input image 41 and the frame region segments 33*a* and between the background image 32 of the template image 31 and the frame region segments 33*a* are extended nearly in the main scan direction, but are exactly inclined with reference to the main scan direction.

When the image synthesis is finished, the recording sheet 10 is supplied from the supply cassette, moved between the platen roller 11 and the thermal head 12 at retracted position, and sent toward the feed roller set 15. When a front edge of the recording sheet 10 comes to the position of the feed roller set 15, the pinch roller 15*b* is shifted from the released position to the nip position, and nips the front edge of the recording sheet 10. A photo sensor (not shown) is disposed in the vicinity of the feed roller set 15, and detects whether or not the front edge of the recording sheet 10 has come to the position of the feed roller set 15.

When the feed roller set 15 nips the recording sheet 10, the thermal head 12 is moved to a press position. The ultraviolet lamp 20*a* is turned on. Then the stepping motor 16 rotates forwards upon supply of drive pulses at the constant frequency. The stepping motor 16 rotates the capstan roller 15*a* forwards, to convey the recording sheet 10 forwards at a constant speed.

A front edge of an effective recording region of the recording sheet 10 comes to the heating element array 12*a* of the thermal head 12. Then a first line of the synthesized image data of yellow is read from the work memory 29, and sent to the thermal head driver 14. The thermal head driver 14 drives the heating elements 13 of the thermal head 12 simultaneously at first, for application of bias heat energy for yellow to the recording sheet 10.

Then the thermal head driver 14 drives the heating elements 13 according to first yellow line data in the synthesized image data, for image heating. The heating elements 13 generate the image heat energy according to the yellow synthesized image data, and apply it to the recording sheet 10. If a pixel has the yellow synthesized image data of zero (0), then corresponding ones of the heating elements 13 are not driven, and generate no heat.

The heating elements 13 are colored at a density according to the synthesized image data of yellow on the condition of the coloring characteristic of the yellow coloring layer. Yellow dots are formed in the pixels PS to constitute the first yellow line. After the application of the image heat energy, the heating elements 13 are left to stand for the purpose of cooling.

During the cooling period, second yellow line data in the synthesized image data is read from the work memory 29, and sent to the thermal head driver 14. When a position in the recording sheet 10 for a second line reaches the heating element array 12*a*, the cooling period finishes. The second line starts being recorded. In a manner similar to the first line, the heating elements 13 are driven simultaneously for the bias heating. At the end of this, the heating elements 13 are selectively driven according to the synthesized image data for the second line of yellow, so that the image heat energy is applied in order to record the second line. Then a third line and succeeding lines are recorded for the synthesized image of yellow.

Portions of the recording sheet 10 with the yellow synthesized image recorded are moved to the position of the yellow fixer 20. Yellow fixing ultraviolet rays are emanated by the ultraviolet lamp 20*a* and fix the yellow coloring layer. After the recording of the final line of the yellow synthesized image, the recording sheet 10 are conveyed farther until the rear edge of the effective recording region is moved past the yellow fixer 20.

When a rear edge of the effective recording region is conveyed past the yellow fixer 20, then the ultraviolet lamp 20*a* is turned off. The stepping motor 16 is stopped provisionally. The thermal head 12 is swung to the retracted position. Then the stepping motor 16 is rotated backwards. The feed roller set 15 conveys the recording sheet 10 to an upstream position along the conveying path. During the conveyance, the front edge of the effective recording region reaches the position of the thermal head 12. Rotation of the feed roller set 15 is stopped. The thermal head 12 is swung to the press position. Furthermore, the ultraviolet lamp 21*a* is turned on.

After the thermal head 12 is set in the press position, the stepping motor 16 is rotated again in the forward direction, for the feed roller set 15 to convey the recording sheet 10 forwards along the conveying path. In the course of the conveyance, the heating element array 12*a* applies magenta bias heat energy and magenta image heat energy to the recording sheet 10, and records a magenta synthesized image one line after another. In the magenta image heating, the heating elements 13 are selectively driven according to the synthesized image data of magenta read from the work memory 29 one line after another.

The portion of the recording sheet 10 with the magenta image recorded is subjected to magenta fixing ultraviolet rays from the ultraviolet lamp 21*a*. The magenta coloring layer is fixed optically.

The rear edge of the effective recording region is conveyed past the magenta fixer 21. The feed roller set 15 conveys the recording sheet 10 in the upstream direction in the manner the same as above. Then the recording sheet 10 is conveyed again forwards in the downstream direction. The heating element array 12*a* records the cyan synthesized image one line after another. The recording sheet 10 after recording the final cyan line is further conveyed, and ejected through the exit slot.

Figure 9:
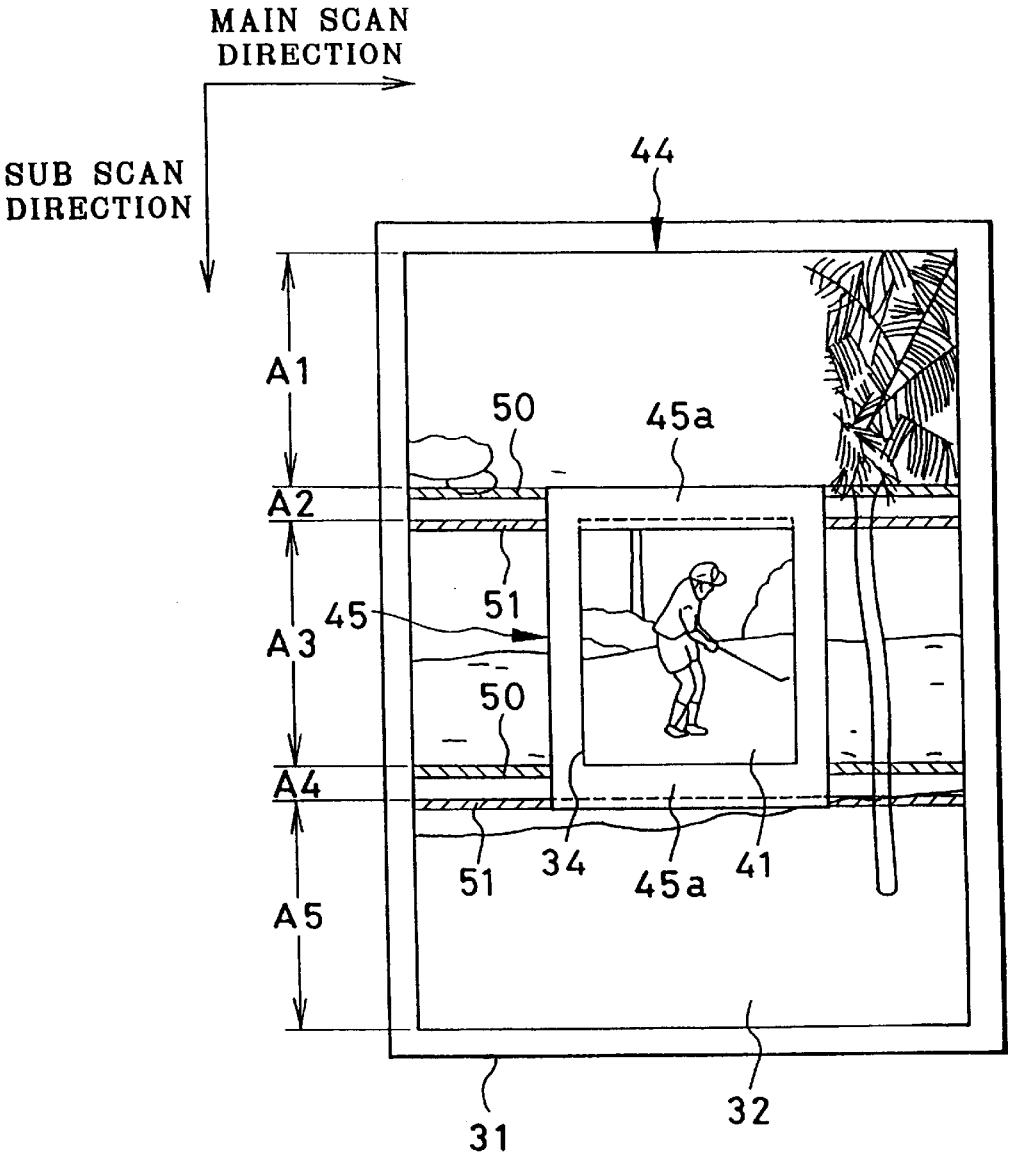
FIG. 9 (PRIOR ART)
FIG. 9 is an explanatory view in plan, illustrating a recording sheet with a synthesized image printed according to the prior art.

In FIG. 9, a synthesized image 44 recorded according to the prior art is illustrated. The template image 31 is provided with a frame region or frame space 45, which is defined about the insertion region 34 in the manner of the template image 31 in FIG. 3. Frame region segments 45*a* in the frame region 45 are parallel with the main scan direction. The synthesized image 44 is printed in a combination of the input image 41 and the background image 32 in the template image 31 having a considerably high density.

In the recording of the area A1 with the thermal head 12, nearly all the heating elements 13 are driven for the bias heating and image heating. The average temperature of the heating elements 13 or the temperature of the heating element array 12*a* is high. The temperature of the surface of the recording sheet 10 is high in contact with the heating element array 12*a*. Thus the coefficient of friction between the heating element array 12*a* and the recording sheet 10 is kept small. The load to the conveyance is relatively small. There occurs no great distortion of the platen roller 11 or the feed roller set 15, no great distortion of the roller shaft 17 as a transmission, no great error in the stop position of the rotor or the stepping motor 16, and no great amount of distortion in the conveyor system.

After the area A1 is recorded, the heating element array 12*a* relatively comes to an area A2 having the frame region segment 45*a* parallel with the main scan direction. The first line of the area A2 starts being recorded. All the heating elements 13 operate for the bias heating. But some of the heating elements 13 associated with the frame region segment 45*a* in the heating element array 12*a* are stopped and do not generate the image heat energy. The temperature of the heating element array 12*a* abruptly becomes low. A friction coefficient between the recording sheet 10 and the heating element array 12*a* becomes high to increase the load in conveyance. Distortion in the conveyor system increases to lower the conveying speed of the recording sheet 10. A conveying amount of the recording sheet 10 is decreased.

Thus the heat energy per unit area ($mJ/mm^2$) applied to the first line of the template image 31 in the area A2 becomes high. A high-density stripe 50 being deeply colored in yellow is recorded in the background image 32.

For the second line and its succeeding lines of the area A2, the heating elements 13 generate only a small amount of heat, because only the bias heating is effected. The temperature of 12*a* becomes still lower. However this change in the temperature is not abrupt. The load in the conveyance comes to balance with the distortion in the conveyor system. The recording sheet 10 being conveyed comes again to have the conveying speed. The background image 32 is recorded at the yellow density being expected originally.

Then the heating element array 12*a* is relatively moved to the area A3. In the area A3, portions of the template image 31 and the input image 41 are recorded. Nearly all the heating elements 13 start recording the input image 41 in accordance with the frame region segment 45*a* parallel to the main scan direction. The temperature of the heating element array 12*a* abruptly rises. The coefficient of friction between the recording sheet 10 and the heating element array 12*a* drops, to decrease the load to the conveyance. In response to the decrease in the load, an amount of distortion of the conveyor system is also decreased. The speed of conveying the recording sheet 10 becomes high abruptly to increase the conveying amount of the recording sheet 10. Thus the heat energy per unit area ($mJ/mm^2$) becomes low. A low-density stripe 51 being colored in yellow only lightly is recorded in the background image 32.

In the recording to the area A4 after the area A3, the high-density stripe 50 appears in the image in the same manner as the recording to the area A2 after the area A1. In the recording to the area A5 after the area A4, the low-density stripe 51 appears. Also, high- and low-density stripes occur in the magenta recording and the cyan recording. The high-density stripes of the three colors are overlapped and become black stripes finally.

Note that a drop in the density occurs also upon the start of recording the area A1. However, starting points of the area A1, even if colored lightly, are indiscernible with a blank margin of the recording sheet 10, and do not cause any problem. Furthermore, no problem occurs at the starting points of the area A3 between two portions of the low-density stripe 51, or at the ending points of the area A4 between two portions of the low-density stripe 51.

In contrast to the recording of the synthesized image 44, the frame region segments 33*a* with the inclination according to the present invention reliably prevents unevenness in the recorded density. In the sequence from the recording of the background image 32 to the recording of the frame region segment 33*a*, the number of the heating elements being turned off for the image heating is increased gradually. The number of the heating elements being turned on for the image heating is decreased gradually. This operation is also effective in the sequence from the recording of the input image 41 to the recording of the frame region segment 33*a*. There does not occur an event in which all the heating elements 13 stop in the image heating. The heating element array 12*a* is kept from abruptly having a low temperature. The conveying speed does not abruptly become low. No black stripe occurs.

In the sequence from the recording of the frame region segment 33*a* to the recording of the background image 32 in the template image 31, the number of the heating elements being turned on for the image heating is increased gradually. The number of the heating elements being turned off for the image heating is decreased gradually. This operation is also effective in the sequence from the recording of the frame region segment 33*a* to the recording of the input image 41. The temperature of the heating element array 12*a* does not rise abruptly. The conveying speed does not rise abruptly. No white stripe occurs.

Figure 5:
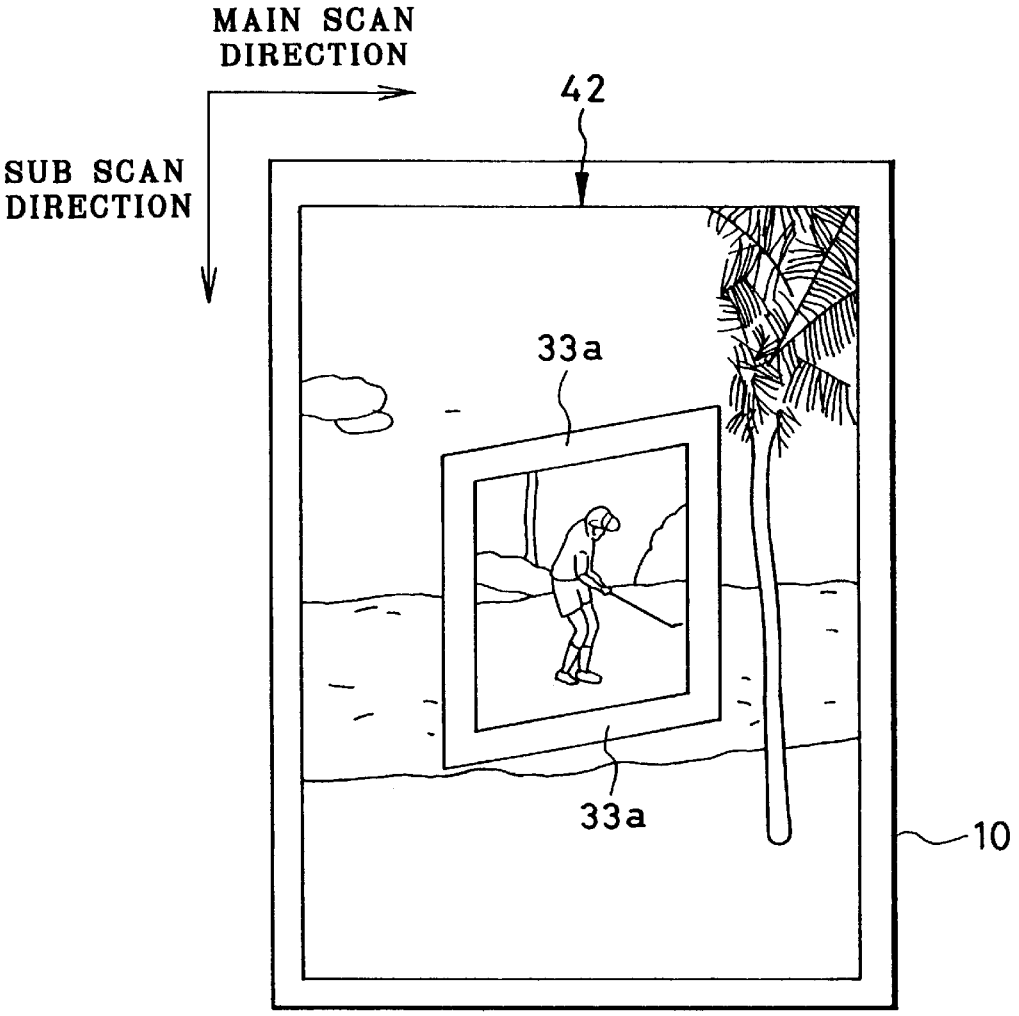
FIG. 5 is an explanatory view in plan, illustrating a thermosensitive recording sheet with the synthesized image of FIG. 4.

Consequently, the synthesized image 42 in FIG. 5 without dark or blank stripes can be recorded on the recording sheet 10 with the small inclination of the frame region segments 33*a* with reference to the main scan direction. Of course, the inclination of the frame region segments 33*a* is sufficiently small. The image quality of the print of the recording sheet 10 is not influenced.

Figure 6:
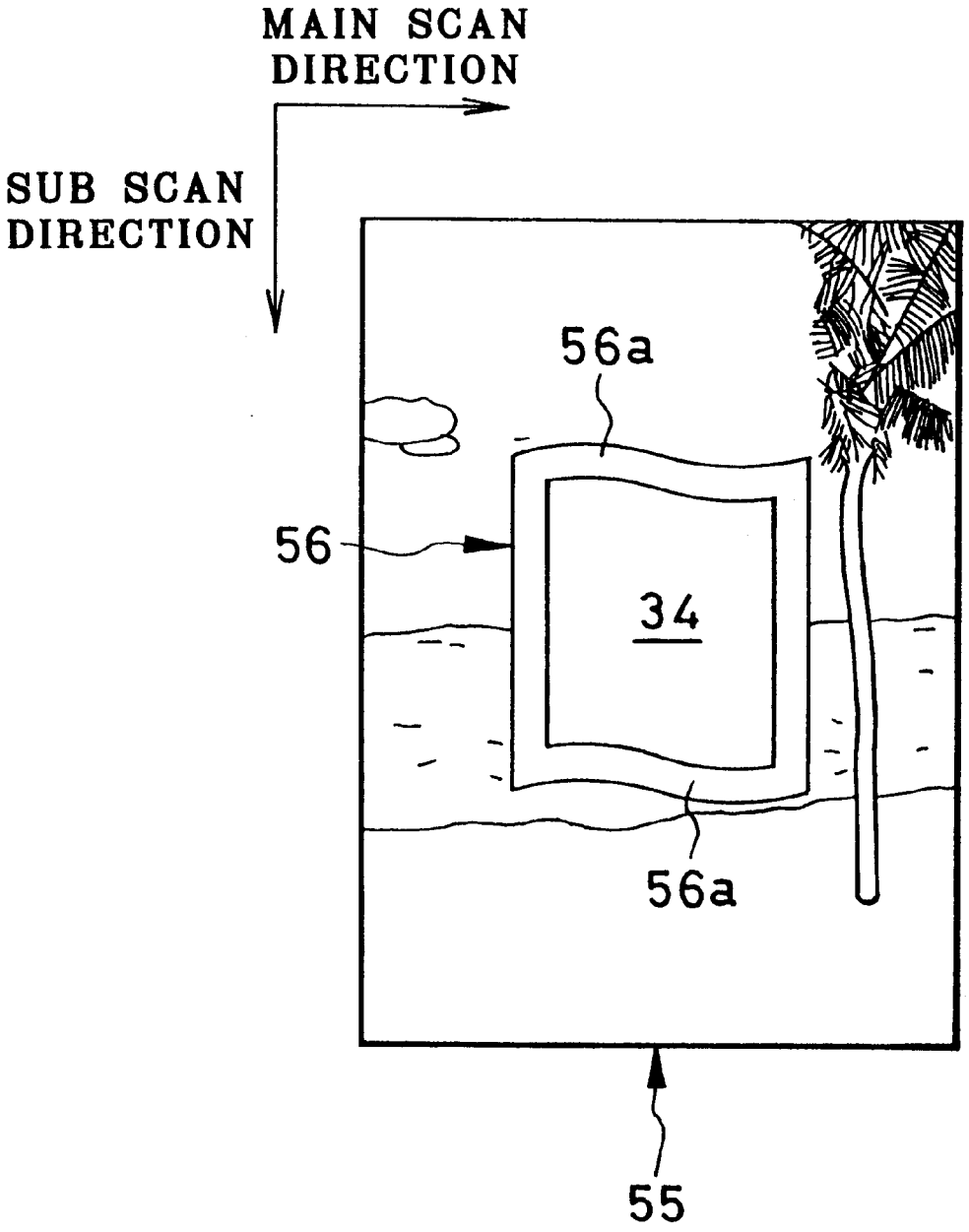
FIG. 6 is an explanatory view in plan, illustrating another preferred template image, a frame region and an insertion region.

In FIG. 6, another preferred embodiment is illustrated, in which a template image 55 is provided with a frame region or frame space 56, of which frame region segments 56*a* are horizontal, but curved, and not parallel with the main scan direction. Thus no stripes of low or high density are created. Of course, it is possible to enhance or reduce the curvature of the frame region segments 56*a* for the purpose of providing the frame region segments 56*a* either with an agreeably conspicuous appearance or with an indiscernible appearance.

Figure 7:
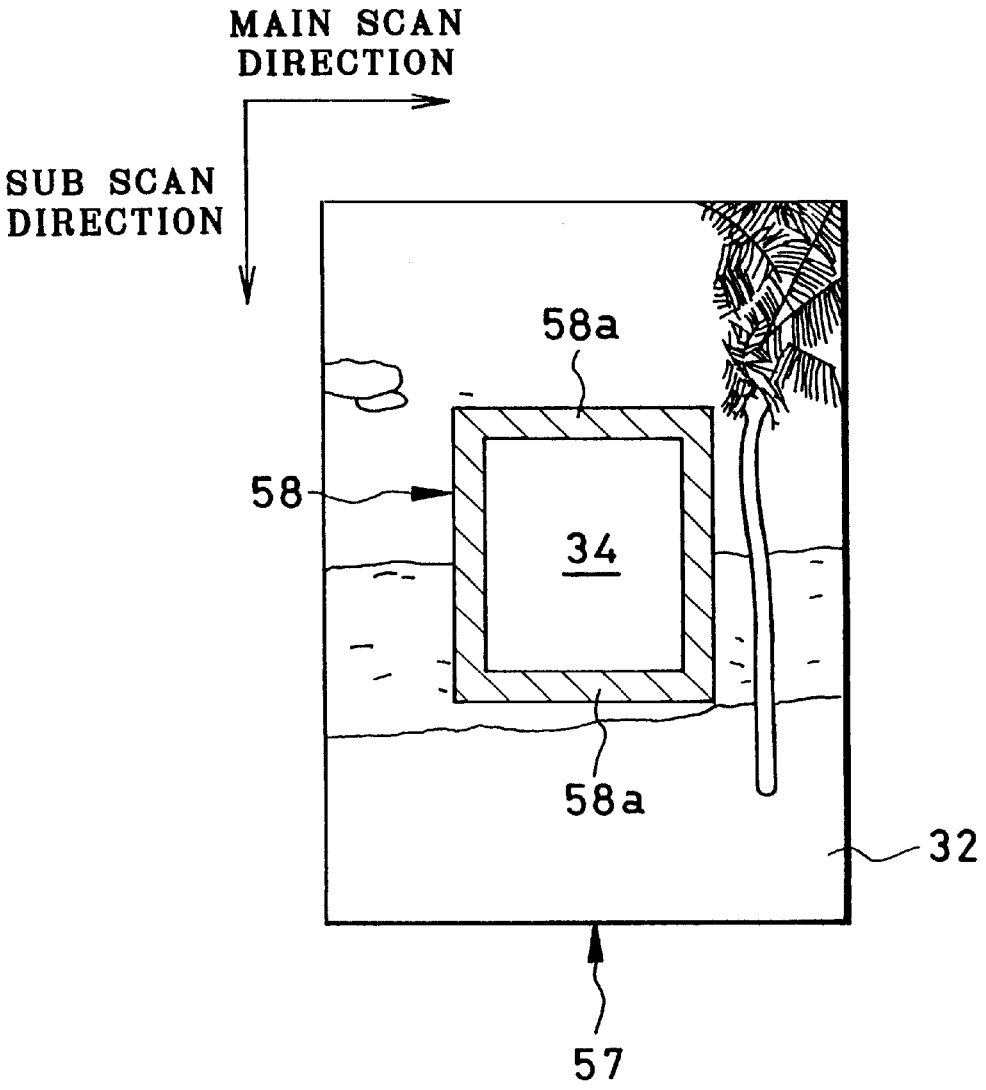
FIG. 7 is an explanatory view in plan, illustrating still another preferred template image which is associated with a gray frame image.

In FIG. 7, a template image 57 is provided with a frame image 58 of a light gray color for the purpose of avoiding the occurrence of dark or blank stripes. Frame image segments 58*a* are parallel with the main scan direction. In the use of the template image 57, the temperature of the heating element array 12*a* does not change so abruptly as when the frame is blank as a space. Dark or blank stripes are effectively prevented from occurring.

The frame image segments 58*a* herein described are colored in gray. It is possible to leave blank a pair of vertical frame image segments in the frame image 58 without coloring in gray, and only to color the frame image segments 58*a* in gray. Also the frame image 58 may be so colored that its density is gradually changed from the color of the background image 32 to that of the insertion region 34 in a continuous manner, or is gradually changed from the color of the background image 32 to gray and from gray to the color of the insertion region 34. Any suitable color may be used for coloring the frame image 58 at a medium density. For this suitable color, all of the yellow, magenta and cyan coloring layers should be colored over the minimum density in the density range. For any of the three colors, it is preferable that the predetermined medium density of the color of the frame image 58 is preferably as high as to be recordable upon application of at least 120% as much heat energy to the recording sheet 10 as the bias heat energy.

According to the above embodiment, the frame image segments 58*a* are a simple gray area without an object image. However, it is possible in a grayish manner to color a narrow part inside the frame image segments 58*a* on the outermost side of the input image 41, and also a narrow part inside the frame image segments 58*a* on the innermost side of the background image 32.

Figure 8:
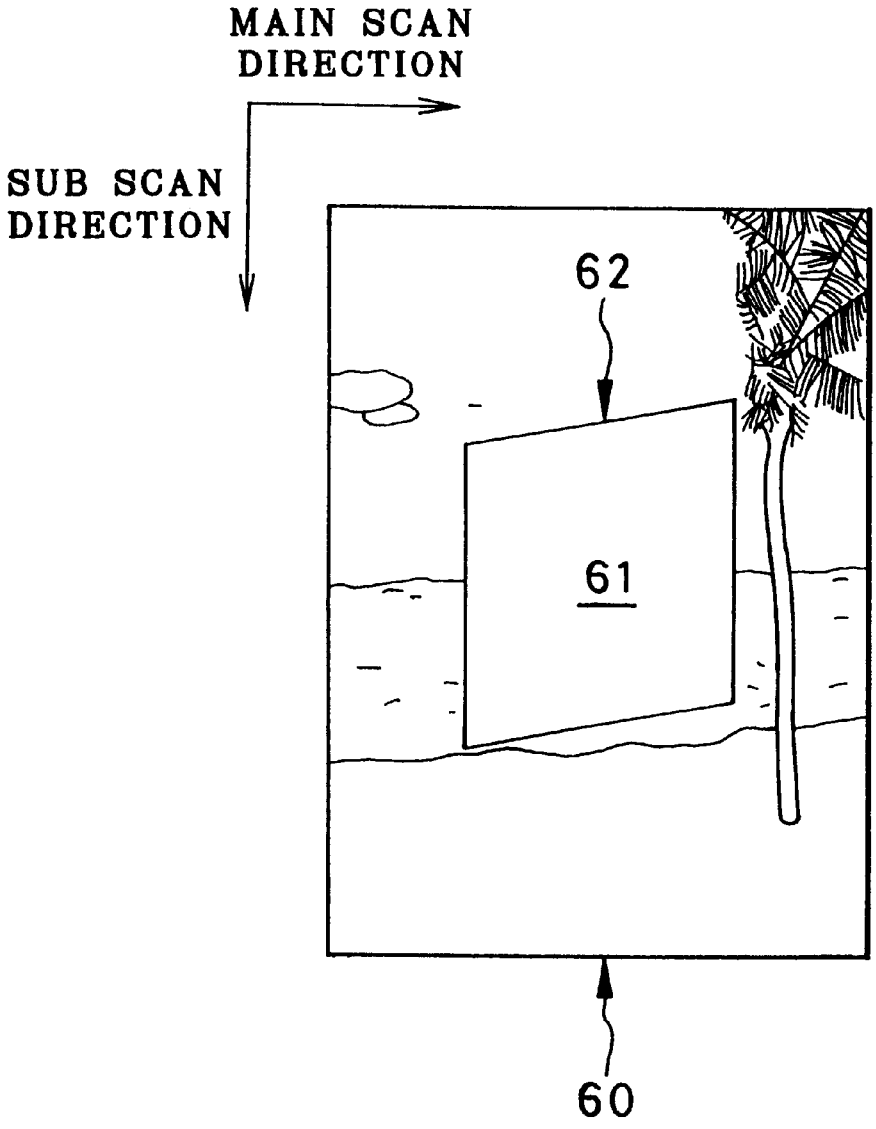
FIG. 8 is an explanatory view in plan, illustrating another preferred template image at which there is no frame region.

In the above embodiments, the frame region or frame space exists around the insertion region inside the template image. Also, a template image 60, illustrated in FIG. 8, may have an insertion region 61 without a frame region or frame image. A borderline 62 between the template image 60 and the insertion region 61 is set determined non-parallel with the main scan direction, so as to prevent occurrence of unevenness in density. This is effective even if a difference in the density between the background image 32 of the template image 60 and an inserted input image is considerable. In FIG. 8, two portions of the borderline 62 extending in the main scan direction are straight with an inclination. However those portions may be curved.

In the above embodiment, the thermal printer is a one-head three-pass type in which the single thermal head is used, and a full-color image is recorded by three-color frame-sequential recording. But a thermal printer in the present invention may be a three-head one-pass type in which three thermal heads are used and the recording sheet 10 is conveyed in one direction for one time. Also a platen drum of a great diameter may be used for supporting the color thermosensitive recording sheet on the periphery thereof.

In the above embodiments, the thermal recording of the type of the color direct thermal recording is used. However, images can be recorded by a printer of a thermal transfer type, examples of which are a sublimation type and a wax-transfer type. The embodiment of FIG. 7 can be used for printers of the sublimation type or the wax-transfer type in which ink ribbon is heated to transfer ink to recording paper by sublimating or melting the ink. The predetermined density of the gray color of the frame image 58 is preferably as high as to be recordable upon application of at least 120% as much heat energy to the ink ribbon as the bias heat energy.

In general, the input image 41 has a rectangular quadrilateral shape, and has first and second side lines extending in the main scan direction. In view of the inclination or curvature, the first side line is associated with an inner borderline of the frame region segments 33*a*, 56*a*, but offset therefrom with a difference. Consequently, the image synthesis circuit 26 corrects the input image data in consideration of the difference, for adapting a portion of the input image 41 along the first side line to the inner borderline of the frame region segments 33*a*, 56*a*.

For effecting this correction, the image synthesis circuit 26 produces magnification-changed image data. The magnification-changed data is obtained by processing the input image data to enlarge the input image 41, and by deleting partial data from the processed data in the image synthesis circuit 26 regarding portions overlapping with the frame region segments 33*a*, 56*a*. Accordingly it is possible to eliminate the above-mentioned difference, because the first side line of the input image 41 is caused to lie on the inner borderlines of the frame region segments 33*a*, 56*a*.

In the above embodiments, the thermal printer is a full-color printer. However the thermal printer may be monochromatic.

In the above embodiments, the insertion region is located at the center of the template image. However an insertion region may be located at any off-centered position inside the template image, for example along one of the four edges, or at one of the four corners. The frame regions 33 and 56, the frame image 58 and the borderline 62 may have one straight line shape, an L-shape, or a channel shape.

Furthermore, the insertion region may have a rectangular quadrilateral shape, and may be disposed with an inclination inside the template region.

In the above embodiments, forms of the input image and the template image are foreground and background scenes, of which examples are a golf player and a view of a golf course. However, the input image and the template image may have any relationship in their forms, or may be combined in any manner desired by a user. The template image may be a decorative pattern, or letters and words to constitute a phase or passage.

In the above embodiments, the frame region 33 and 56 and the frame image 58 are a continuous line without gap. However, the frame region 33 and 56 and the frame image 58 can have a form of a broken line. For the frame region 33 and 56, each of their inner and outer borderlines may be comb-shaped, sawtooth-shaped, or shaped in any intermittent manner. The frame image 58 may be constituted by a train of dots, between which small blank sections are disposed.

In the above embodiment, each of the frame region segments 33*a* and the horizontal portions of the borderlines 62 has a shape of a single inclined linear portion. Furthermore, each of the frame region segments 33*a* and the horizontal portions of the borderlines 62 can have a zigzag shape in combination of two or more inclined linear portions, or a patterned shape of inclined linear portions of plural kinds. In the above embodiment, each of the frame region segments 56*a* consists of a combination of two long portions curved in opposite directions. Furthermore, each of the frame region segments 56*a* can have a corrugated shape in combination of two or more curved long portions, or a patterned shape of curved long portions of plural kinds.

In the above embodiment, the borderlines of the frame region segments 33*a* and 56*a* and the borderlines 62 do not include any portion parallel with the main scan direction. However, those borderlines may have a combined shape including a small portion parallel with the main scan direction. Of course, it is desirable in the present invention that such a small portion should be as small as possible. A major horizontal part of the borderlines of the frame region segments 33*a*, 56*a* and the borderline 62 should be inclined.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method in which recording heat energy is applied by a thermal head to an effective recording region on a recording material, and simultaneously said thermal head and said recording material are conveyed relative to one another in a sub scan direction for recording at least one input image to said recording material, said thermal head including an array of heating elements arranged in a main scan direction substantially perpendicular to said sub scan direction, said thermal printing method comprising:

separating said effective recording region into an insertion region, a template region and a frame region by use of first and second borderlines, said first borderline being defined between said insertion region and said frame region, said second borderline being defined between said template region and said frame region, said first borderline including at least one first borderline segment being one of straight and curved, and being inclined with reference to said main scan direction without parallelism; and recording said input image in said insertion region, and at least one template image in said template region, so as to obtain a hard copy with a synthesized image recorded in said effective recording region and including said input image and said template image.

2. A thermal printing method as defined in claim 1, wherein a combination of said template image with multiple shapes of said frame region is predetermined.

3. A thermal printing method as defined in claim 2, wherein said second borderline includes at least one second borderline segment being one of straight and curved, and being inclined with reference to said main scan direction without parallelism.

4. A thermal printing method as defined in claim 3, wherein said heating element array, while positioned at said first or second borderline segment, changes progressively from one of first and second states to another thereof, and when in said first state, a relatively small number of heating elements included in said heating element array are driven, and when in said second state, a relatively large number of heating elements included in said heating element array are driven.

5. A thermal printing method as defined in claim 3, wherein said insertion region and said frame region have a substantially quadrilateral shape, and said template region is disposed around said insertion region with said frame region.

6. A thermal printing method in which recording heat energy is applied by a thermal head to an effective recording region on a recording material, and simultaneously said thermal head and said recording material are conveyed relative to one another in a sub scan direction for recording at least one input image to said recording material, said thermal head including an array of heating elements arranged in a main scan direction substantially perpendicular to said sub scan direction, said thermal printing method comprising:

separating said effective recording region into an insertion region and a template region by use of a borderline, said borderline including at least one borderline segment being one of straight and curved, and being inclined with reference to said main scan direction without parallelism; and recording said input image in said insertion region, and at least one template image in said template region, so as to obtain a hard copy with a synthesized image recorded in said effective recording region and including said input image and said template image.

7. A thermal printing method as defined in claim 6, wherein said insertion region has a substantially quadrilateral shape, and said template region is disposed around said insertion region.

8. A thermal printing method in which recording heat energy is applied by a thermal head to an effective recording region on a recording material, and simultaneously said thermal head and said recording material are conveyed relative to one another in a sub scan direction for recording at least one input image to said recording material, said thermal head including an array of heating elements arranged in a main scan direction substantially perpendicular to said sub scan direction, said thermal printing method comprising:

separating said effective recording region into an insertion region and a template region by use of a frame region including at least one frame region segment extending in, but not parallel to, said main scan direction; and recording said input image in said insertion region, recording at least one template image in said template region, and coloring said frame region segment at a predetermined density, so as to obtain a hard copy with a synthesized image recorded in said effective recording region and including said input image and said template image.

9. A thermal printing method as defined in claim 8, wherein said insertion region and said frame region have a substantially quadrilateral shape, and said template region is disposed around said insertion region with said frame region.

10. A thermal printing method as defined in claim 9, wherein a combination of said template image with multiple shapes and coloring of said frame region is predetermined.

11. A thermal printing method as defined in claim 9, wherein said frame region has four frame region segments to be colored at said predetermined density.

12. A thermal printing method as defined in claim 11, wherein said frame region is colored in gray at said predetermined density.

13. A thermal printing method as defined in claim 9, wherein said recording heat energy is a combination of bias heat energy and image heat energy, said bias heat energy is so predetermined as to set said recording material in a heated state directly short of starting coloring said recording material, and said image heat energy is determined according to a density to be recorded to said recording material;

said predetermined density is so predetermined that said recording material is colorable thereat upon applying at least 120% as high heat energy to said recording material as said bias heat energy.

14. A thermal printer, including a thermal head, having an array of heating elements arranged in a main scan direction, for applying recording heat energy to an effective recording region on a recording material in accordance with input image data, and a feed roller, actuated while said thermal head applies said recording heat energy, for conveying said thermal head and said recording material relative to one another in a sub scan direction substantially perpendicular to said main scan direction, so as to record at least one input image to said recording material, said thermal printer comprising:

a first memory which stores said input image data;

a second memory which stores template data and information of first and second borderlines, said template data representing at least one template image, said first and second borderlines separating said effective recording region into a quadrilateral insertion region, a frame region thereabout and a template region thereabout, said frame region having a predetermined width, said first borderline being defined between said insertion region and said template region, said second borderline being defined between said template region and said frame region, said first borderline including at least one first borderline segment being one of straight and curved, and being inclined with reference to said main scan direction without parallelism;

an image synthesis circuit which produces synthesized image data in accordance with said input image data, said template data and said information of said first and second borderlines, said synthesized image data representing a synthesized image in which said input image is disposed in said insertion region and said template image is disposed in said template region; and a third memory which stores said synthesized image data, said thermal head being driven to record said synthesized image.

15. A thermal printer as defined in claim 14, wherein said second borderline includes at least one second borderline segment being one of straight and curved, and being inclined with reference to said main scan direction.

16. A thermal printer, including a thermal head, having an array of heating elements arranged in a main scan direction, for applying recording heat energy to an effective recording region on a recording material in accordance with input image data, and a feed roller, actuated while said thermal head applies said recording heat energy, for conveying said thermal head and said recording material relative to one another in a sub scan direction substantially perpendicular to said main scan direction, so as to record at least one input image to said recording material, said thermal printer comprising:

a first memory which stores said input image data;

a second memory which stores template data and frame data, said template data representing at least one template image, said frame data representing a frame image, said frame image having a predetermined width, and separating said effective recording region into a quadrilateral insertion region and a template region thereabout, said frame image including at least one frame image segment extending in, but not parallel to, said main scan direction, and having a predetermined density;

an image synthesis circuit which produces synthesized image data in accordance with said input image data, said template data and said frame data, said synthesized image data representing a synthesized image in which said input image is disposed in said insertion region, said template image is disposed in said template region, and said frame image is disposed therebetween; and a third memory which stores said synthesized image data, said thermal head being driven to record said synthesized image.

17. A thermal printer as defined in claim 16, wherein said recording heat energy is a combination of bias heat energy and image heat energy, said bias heat energy is so predetermined as to set said recording material in a heated state directly short of starting coloring said recording material, and said image heat energy is determined according to a density to be recorded to said recording material;

said predetermined density is so predetermined that said recording material is colorable thereat upon applying at least 120% as high heat energy to said recording material as said bias heat energy.

* * * * *